US009169104B2

(12) United States Patent
Legeret et al.

(10) Patent No.: US 9,169,104 B2
(45) Date of Patent: Oct. 27, 2015

(54) ACTIVATING A SAFETY GEAR

(75) Inventors: Benoit Legeret, Sao Paulo (BR); Eric Birrer, Buchrain (CH); Marcus Junig, Emmenbrucke (CH); Philipp Zimmerli, Aarburg (CH)

(73) Assignee: Inventio AG, Hergiswil (CH)

( * ) Notice: Subject to any disclaimer, the term of this patent is extended or adjusted under 35 U.S.C. 154(b) by 705 days.

(21) Appl. No.: 13/314,765

(22) Filed: Dec. 8, 2011

(65) Prior Publication Data

US 2012/0152663 A1 Jun. 21, 2012

(30) Foreign Application Priority Data

Dec. 17, 2010 (EP) ..... 10195791

(51) Int. Cl.
*B66B 5/18* (2006.01)
*B66B 5/20* (2006.01)

(52) U.S. Cl.
CPC .... *B66B 5/18* (2013.01); *B66B 5/20* (2013.01)

(58) Field of Classification Search
CPC ..... B66B 5/18; B66B 5/20
USPC ..... 187/374–375, 368
See application file for complete search history.

(56) References Cited

U.S. PATENT DOCUMENTS

| | | | | |
|---|---|---|---|---|
| 2,493,553 | A | 1/1950 | Sahlin | |
| 7,080,717 | B2 * | 7/2006 | Ito | 187/350 |
| 7,299,898 | B2 * | 11/2007 | Husmann | 187/373 |
| 7,575,099 | B2 | 8/2009 | Oh et al. | |
| 2007/0089938 | A1 | 4/2007 | Ishioka et al. | |
| 2010/0300813 | A1 | 12/2010 | Kigawa et al. | |
| 2011/0226560 | A1 * | 9/2011 | Husmann | 187/359 |
| 2013/0248298 | A1 * | 9/2013 | Osmanbasic et al. | 187/359 |
| 2014/0008157 | A1 * | 1/2014 | Terry et al. | 187/359 |

FOREIGN PATENT DOCUMENTS

| | | | |
|---|---|---|---|
| DE | 127751 | C | 1/1902 |
| DE | 476095 | C | 5/1929 |
| EP | 0543154 | A1 | 5/1993 |
| EP | 0640552 | A1 | 3/1995 |
| EP | 1733992 | A1 | 12/2006 |
| EP | 2112116 | A1 * | 10/2009 |
| EP | 2154096 | A1 | 2/2010 |
| WO | 2008057116 | A1 | 5/2008 |
| WO | 2010107409 | A1 | 9/2010 |
| WO | WO 2012128758 | A1 * | 9/2012 |
| WO | WO 2013083430 | A1 * | 6/2013 |

* cited by examiner

*Primary Examiner* — Michael Mansen
*Assistant Examiner* — Diem Tran
(74) *Attorney, Agent, or Firm* — Fraser Clemens Martin & Miller LLC

(57) ABSTRACT

In this elevator system, a traveling body has arranged upon it a safety gear for braking and holding the traveling body tight on the guiderail, or on a braking rail. The safety gear is connected to a device for actuating the safety gear, which can also actuate the safety gear. The device for actuating the safety gear contains a coupler body, which can be pressed against the elevator hoistway, possibly against the guiderail or braking rail, wherein actuation of the safety gear is effected by a relative movement between the pressed-on coupler body and the safety gear. For this purpose, the coupler body can contain a curved coupler surface, which, in case of need, is brought into engagement with the elevator hoistway, or with the guiderail or braking rail.

24 Claims, 9 Drawing Sheets

Fig. 1
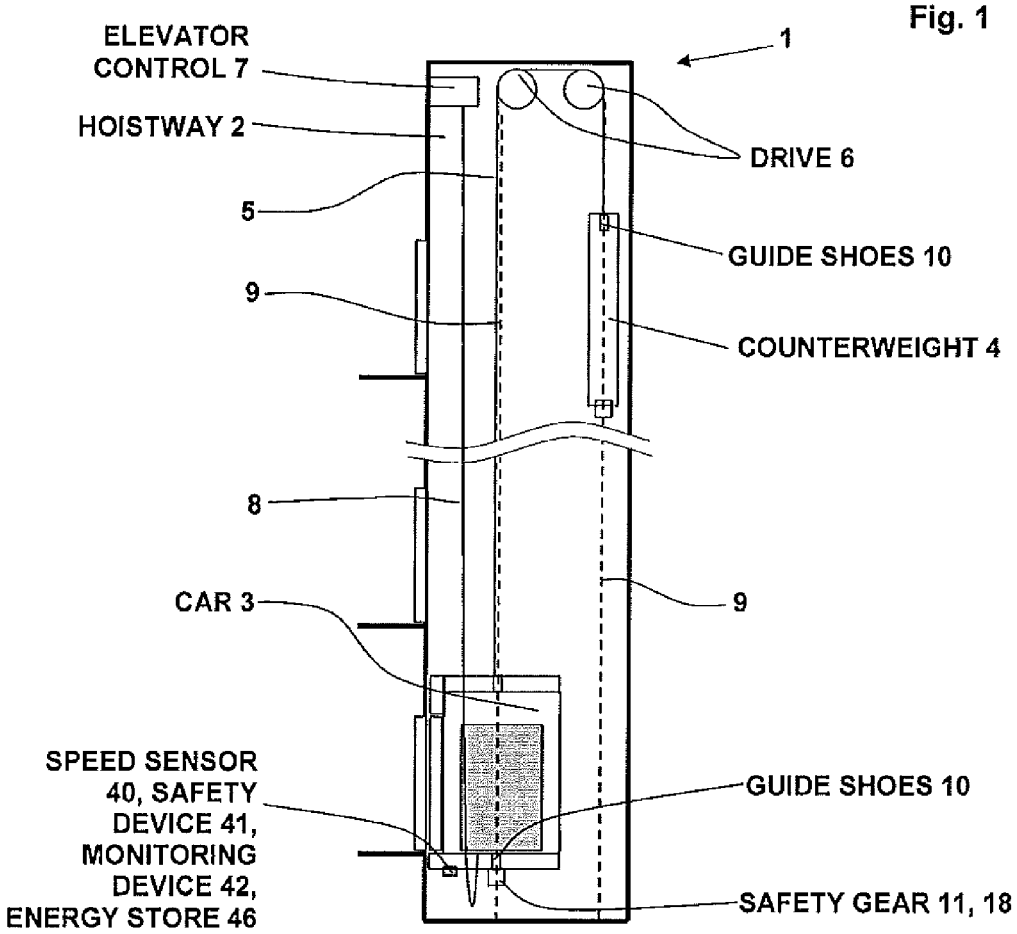
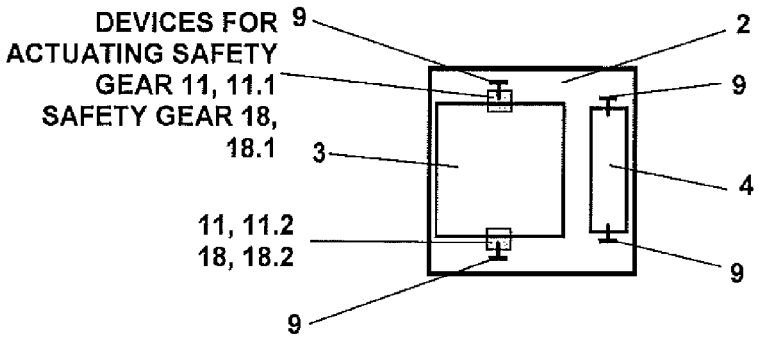
Fig. 2

ACTIVATING A SAFETY GEAR

CROSS-REFERENCE TO RELATED APPLICATION

This application claims priority to European Patent Application No. 10195791.8, filed Dec. 17, 2010, which is incorporated herein by reference.

FIELD

The disclosure relates activating a safety gear for an elevator installation.

BACKGROUND

Elevator systems are built into buildings. They comprise an elevator car which, via suspension means such as suspension ropes or suspension belts, is connected to a counterweight or to a second elevator car. By means of a drive, which can be chosen to act on the suspension means, or directly on the car or counterweight, the car is moved along essentially vertical guiderails. The elevator system is used to transport persons and goods between one or more stories in the building.

The elevator system contains apparatus to secure the elevator car in case of failure of the drive or of the suspension means, or to prevent undesired drifting away or falling when stopping at a floor. For this purpose, safety gears are generally used which, in case of need, can brake the elevator car on the guiderails.

Historically, such safety gears were actuated by mechanical speed governors. Today, however, electronic monitoring devices are also used, which, in case of need, can activate braking apparatus or safety gears.

So as to be able nonetheless to rely on known safety gears, electromechanical actuating units are often required which, when correspondingly triggered, can actuate safety gears.

From EP0543154 such a device is known. By its means, in case of need, an auxiliary caliper brake is brought into engagement with a guiderail, and this auxiliary caliper brake actuates an existing lever system, by means of which safety gears are actuated. This auxiliary caliper brake is designed to be able to move the lever system and mass components of the safety gear, or to actuate the safety gear. The electromagnetic units are dimensioned correspondingly large.

From WO 2008/057116 a similar device is known. By this means, in case of need, a coupler body that is arranged in a safety gear is pressed against a guiderail, whereby the safety gear is actuated.

From U.S. Pat. No. 7,575,099 a further such device is known. In this solution, in case of need, engagement wedges of a safety gear are actuated directly by springs. The springs are pretensioned by an electromagnet and, in case of need, the pretensioned springs are released. The springs can be reset or retensioned again by means of a spindle drive. This electromagnet is dimensioned correspondingly large, since the entire pretension force of a plurality of springs should be absorbed directly and held.

SUMMARY

At least some of the disclosed embodiments allow for actuation of a safety gear in an elevator system by means of electric triggering, and to its integration in the elevator system.

An elevator system serves to transport goods and persons in a building. For this purpose, to accommodate the persons and goods, the elevator system contains at least one elevator car, as well as generally a counterweight. Counterweight and elevator car are connected together via one or more suspension means such as, for example, a suspension rope, a suspension belt, or another suspension means. These suspension means are passed over a reverser pulley or drive sheave, and the counterweight and the elevator car thereby move in opposite directions in the building, more precisely in an elevator hoistway that is provided in the building. To prevent the car, and in some cases also the counterweight, from falling, or also to prevent other faulty behavior of these moving bodies—"moving body" being hereinafter understood to mean either the elevator car or the counterweight—at least the elevator car, and in some cases also the counterweight, is equipped with a safety gear. The moving body generally contains two safety gears, each of which is assigned to a guiderail. The guiderails—generally two guiderails—guide the moving body along the elevator hoistway, and contain a web on which the safety gear can engage for the purpose of braking. Actuation of the safety gear is effected by, for example, raising an engagement wedge, an engagement roller, or an engagement eccentric, or turning one or more of the latter into an engaged position. Such an embodiment of a conventional safety gear is, for example, an eccentric safety gear. Herein, to initialize a braking or engagement operation, the engagement element in the form of an eccentric must be turned so that it comes into contact with the guiderail, which it then grips and thereby can generate a gripping and braking force.

In some embodiments, a device for actuating the safety gear that is arranged on the traveling body and connected to the safety gear actuates the safety gear, or raises the engagement wedge or engagement roller, or turns the engagement element into the engaged position. The device for actuating the safety gear contains at least one coupler body, which is mounted swivelably on the traveling body. In case of need, the coupler body is pressed against the elevator hoistway, or possibly against the guiderail or braking rail. By means of a relative movement between the pressed-on coupler body and the safety gear, actuation of the safety gear is effected. The relative movement arises through the coupler body, which is pressed against the elevator hoistway, or guiderails or braking rail respectively, being held tight at the point of contact with the rail, and the traveling body, which continues to move with the safety gear, thereby continuing to move relative to this point. The coupler body possibly contains a curve-shaped coupler surface and is arranged swivelably about a swivel axle in the device for actuating the safety gear. In this embodiment, the curve-shaped coupler surface can now swivel the coupler body and thereby raise the engagement wedge, or engagement roller, or engagement element into the engaged position. For this purpose, the engagement body is connected to the engagement wedge, engagement roller, or engagement element by means of a connecting bar.

The device for actuating the safety gear can be arranged directly adjacent to, and above or below, the safety gear in a separate housing.

With such a device for actuating the safety gear, the safety gear can be actuated quickly and safely. The coupler body can be operated independent of the safety gear, and can be connected to existing safety gears by means of the connecting bar. Also, the swivel axle or pivot can be easily mounted on, or integrated in, a housing of the device for actuating the safety gear.

Alternatively, the swivel axle or pivot can also be integrated in a housing of the safety gear.

In a variant embodiment, the curve-shaped coupler surface is embodied in such manner that a press-on force of the coupler body on the elevator hoistway, or guiderail or braking rail respectively, increases over a swivel range of the coupler body. The curved embodiment of the coupler surface makes it possible that, with a relatively low press-on force, the swiveling can be initialized, and that over the swivel angle the press-on force increases, and thereby the force that is available for actuating the safety gear also increases.

In a variant embodiment, the traveling body, which is arranged to be movable along at least two guiderails or braking rails, is equipped with at least two safety gears. Of these, a first safety gear interacts with a first guiderail or braking rail, and a second safety gear interacts with a second guiderail or braking rail. Each of the safety gears is connected to a respective device for actuating the safety gear, by which it can be actuated in case of need. In one embodiment, the two swivel axles of the two coupler bodies are coupled together, i.e. for example, by means of a connecting axle. The two coupler bodies are thus swiveled together. The two devices for actuating the safety gear are thus coupled together in such manner that both devices for actuating the safety gear, and thus both safety gears, are actuated essentially synchronously. An unsymmetrical actuation of the safety gears is hereby prevented.

In a variant embodiment, each of the devices for actuating the safety gear is designed in such manner that it alone can actuate the safety gear that is coupled via the swivel axle of the coupler body. The safety of the elevator system is thereby increased. The two devices for actuating the safety gear can be triggered together, and thereby actuate the respective associated safety gear. In the event, for example, of failure of one of the two devices for actuating the safety gear, the remaining device alone is fully capable of actuating both of the safety gears.

In a variant embodiment, the curve-shaped coupler surface of the coupler body is connected to the safety gear via a free-running device. Via a first area of the relative movement between the coupler body, which is pressed against the elevator hoistway, or possibly against the guiderail or braking machine, and the safety gear, only the coupler body is swiveled, with the result that the press-on force of the coupler body on the elevator hoistway, or guiderail or braking rail respectively, is increased. Only via a second area of the relative movement is the safety gear then actuated. This in turn allows the press-on force in the first work-step of the actuation operation to be kept small, since only the coupler body itself need be swiveled. Over this first area, because of the correspondingly formed curve-shaped coupler surface, the press-on force increases, and then correspondingly, in the second area of the relative movement, an increased actuation force is available for actuation of the safety gear.

In a variant embodiment, by means of a press-on spring, possibly by means of a compression spring, the coupler body is pressed against the elevator hoistway, or guiderail or braking rail respectively, and by means of an electromagnet can be held in a ready position. This embodiment can be particularly safe. In the event of failure to trigger, or loss of energy, the electromagnet inevitably deenergizes and the press-on spring presses the coupler body on. Possibly, the electromagnets of two devices for actuating the safety gear are connected together in series. This can additionally ensure that triggering of the safety gears arranged on both sides of the traveling body occurs synchronously. Alternatively, the electromagnet can also only relieve a feeder device so that the coupler body is held, for example by a spring, at a distance from the elevator hoistway, or from the guiderail or braking rail respectively.

In a variant embodiment, the coupler body contains a movable and a fixed coupler part. The movable coupler part is thereby by means of the press-on spring pressable against the elevator hoistway, or guiderail or braking rail respectively, and the electromagnet can hold the movable coupler part in the ready position. The movable coupler part is thereby guided in the fixed coupler part. The movable coupler part can be embodied small and with low mass. The response time can thereby be kept short. The movable coupler part creates the first friction contact with the elevator hoistway, or guiderail or braking rail respectively. After a small swivel movement, the friction contact of the movable coupler part transfers to the fixed coupler part, which, from this moment on, secures the further swivel movement. The coupler surface of the coupler body is formed jointly by the movable and fixed coupler parts. This coupler surface can be non-slip, for example with an embossed, knurled, or otherwise structured surface.

Possibly, the electromagnet, which in this embodiment holds the movable coupler part in the ready position, is arranged in the area of the swivel axle of the coupler body, or possibly directly in the connecting axle of the two devices for actuating the safety gear.

In a variant embodiment, the electromagnet is integrated into an electromechanical feeder device. This electromechanical feeder device is, for example, arranged in the area of the swivel axle, possibly directly in the connecting axle, of the coupler body.

Each connecting axle consists of a connecting element, which is assigned to the respective first and second device for actuating the safety gear, and a connecting element, possibly a connecting tube, which connects the two connecting elements. The length of the connecting element is adapted to a width of the travel body, or to a distance of the two devices for actuating the safety gear. The electromechanical feeder device is now, for example, integrated in, or in areas of, the connecting element. Thereby, for each device for actuating the safety gear, a respective separate feeder device is provided, but which can—as already explained—in case of need also entrain, via the connecting axle, the second device for actuating the safety gear.

In an example, the feeder device consists of the electromagnet in the form of a lifting magnet, which is arranged in the alignment of the connecting element and which, in normal operation, holds an armature pin against the force of an armature spring. The armature pin is provided with a conical, or wedge-shaped, pressure point. Immediately the electromagnet is switched currentless, the armature spring pushes the armature pin away and, via the wedge incline or the conical pressure point, a guide pin is pushed away. This guide pin is a component part of the movable coupler part of the coupler body, and/or is connected to the latter. In normal operation, this guide pin is held with a guide spring in the ready position, so at a distance from the elevator hoistway, or guiderail or braking rail respectively, and in currentless state of the electromagnet via the wedge incline the armature pin pushes the guide pin, together with the movable coupler part, against the elevator hoistway, or guiderail or braking rail respectively. To verify correct response of the device for actuating the safety gear, the working positions can be monitored by switches.

This said form of the feeder device can allow a spacesaving construction, and a holding force of the electromagnet can be chosen to be small. Moreover, the arrangement of the feeder device in the connecting axle can be advantageous since, on swiveling of the coupler body, an axle center of the connecting axle undergoes no displacement and, inside the connecting axle, the electromagnet is protected against dust, grime, and abraded metal such as corrosion dust.

In a variant embodiment, the device for actuating the safety gear further contains a counterpressure roller, which is arranged on a surface of the elevator hoistway, or guiderail or braking rail respectively, that lies opposite the coupler body and which assures the position of the device for actuating the safety gears relative to the elevator hoistway, or guiderail or braking rail respectively. The device for actuating the safety gear can be built into the housing of the device for actuating the safety gear. This housing can be used for fastening to the traveling body, as well as for fastening to the safety gear. With the counterpressure roller that is arranged in the housing, the surface of the elevator hoistway, or guiderail or braking rail respectively, on which the device for actuating the safety gear engages, is relieved. Moreover, in a further development of the solution, a speed sensor can be built into this counterpressure roller, which measures a travel speed of the elevator and, on a critical travel speed being exceeded, automatically immediately triggers the device for actuating the safety gear, and thereby the safety gear. In addition, the second device for actuating the safety gear can also be equipped with a counterpressure roller with speed sensor. A redundant monitoring of the speed can thereby be realized.

In a variant embodiment, in the event of the traveling body coming to a halt, the device for actuating the safety gear is activated. This means that, on halting at a stop, the electromagnet or an equivalent actuator releases the coupler body, whereby the latter is pressed against the elevator hoistway, or guiderail or braking rail respectively. As long as the traveling body moves in a free swivel area of the device for actuating the safety gear, the safety gear is not yet actuated, and the device for actuating the safety gear can be reset by switching the electromagnet on again. If, however, the travel body moves away from the landing by a relatively large amount, or drifts away in uncontrolled manner, the coupler body, which rests against the elevator hoistway, or guiderail or braking rail respectively, actuates the safety gear. A good protection against an unintentional sliding away of the traveling body is thereby obtained.

In a variant embodiment of an elevator system, the traveling body, or primarily the elevator car, contains an electronic safety device, or is connected to the latter. The electronic safety device can detect a deviation of the travel speed from a reference speed and, in case of need, trigger the device for actuating the safety gear, and thereby the safety gear.

Alternatively or complementarily, the traveling body, or primarily the elevator car, contains a monitoring device, or is connected to the latter. The monitoring device is, for example in the event of a standstill of the elevator car, activated, and can detect a possible unexpected drifting away of the elevator car from a standstill, and can, in case of need, trigger the device for actuating the safety gear, and thereby also actuate the safety gear.

In a variant embodiment of an elevator installation, a further traveling body, for example a counterweight, contains a further device for actuating the safety gear as already explained. In an embodiment, this further traveling body possibly contains a speed sensor which is built into the counterpressure roller, as already explained, and it contains an energy supply with energy store which is generated, for example, by means of a following roller generator. This device can then execute a securing of this further traveling body, without further electrical connections being necessary. A status signal can be wirelessly transmitted via a radio connection.

Alternatively, a traveling cable or compensating rope can be used between the traveling bodies, generally between the car and the counterweight, to transmit the necessary signals and energy. In this case, in case of need, self-evidently the speed and safety information can be processed in one of the traveling bodies, and then transmitted to the other traveling body.

In an embodiment of the elevator system, the safety gear is an eccentric safety gear. An eccentric safety gear of this type is known, for example, from disclosure DE2139056. The device for actuating the safety gear can be connected to the eccentric of the eccentric safety gear by means of the connecting bar, by which means a direct actuation of a safety gear of this type is assured. Necessary dimensions of the device for actuating the safety gear can be adapted to the requirements of the safety gear. If the safety gear is embodied for actuation in both directions of travel, in case of need, the device for actuating the safety gear can be designed for two-sided actuation.

In a variant embodiment, the device for actuating the safety gear is supplied with electrical energy from an energy store. This is, for example, a chargeable battery. The energy store prevents, for example, an undesired actuation of the device for actuating the safety gear in the event of a power failure in the building. The traveling body can hence first be brought to a standstill by normal braking measures. This energy store can also supply other functional groups with emergency electric power.

In a variant configuration, a pair of safety gears with associated devices for actuating the safety gear are arranged on the car. The devices for actuating the safety gear are connected together by means of the connecting axle, and both devices for actuating the safety gear are provided with an electromechanical feeder device. The devices for actuating the safety gear, or the electromechanical feeder device, are triggered by the safety device. For example, the safety device triggers the electromagnets of the electromechanical feeder device directly or via corresponding brake control devices. The electromagnets can be, as already described above, connected in series.

The electronic governor can, for example, be a speed-monitoring device such as is used in WO03004397, it can contain separate speed sensors or systems for determining the speed, or it can be a monitoring device, which evaluates a rotational speed of rollers on the car which roll along the guiderails, or it can be a safety monitoring system such as is presented in EP1602610. The safety device can be equipped with electrical energy stores such as batteries, accumulators, or capacitor batteries. With the aid of these energy stores, in the event of a power failure in the building, the safety device is kept active for a predefined time. In case of need, these energy accumulators can be combined for various functional groups. Instead of a pair of safety gears, a plurality of pairs of safety gears with, in each case, respective associated devices for actuating the safety gear, can be mounted on the car.

In another variant configuration, the counterweight is equipped with safety gears which, in the event of a lost suspension force, are actuated by means of a slack-rope monitor or slack-rope trigger. In this case, the safety gear on the counterweight is only actuated on loss of the suspension force at the counterweight, which is the case, for example, on failure of a suspension means. To prevent inadvertent triggering caused, for example, by rope oscillations, the slack-rope monitor is provided with a damping element, such as a pneumatic damper. An advantage of this type of triggering of the safety gear is that no electrical connection of the counterweight to the elevator system is required, and that the counterweight is nonetheless effectively secured against falling. A possible erroneous triggering of the safety gear on the counterweight can be monitored on the car or on the drive since, on triggering of this safety gear, a sudden strong change of load on the drive, or in the suspension means, results.

BRIEF DESCRIPTION OF THE DRAWINGS

The disclosed technologies are explained below using exemplary embodiments and using the figures. Shown are in:

FIG. 1 a diagrammatic view of an elevator system in a side view;

FIG. 2 a diagrammatic view of the elevator system in cross section;

In the figures, the same reference numbers and letters are used for identically functioning parts in all figures.

DETAILED DESCRIPTION

Figure 3:
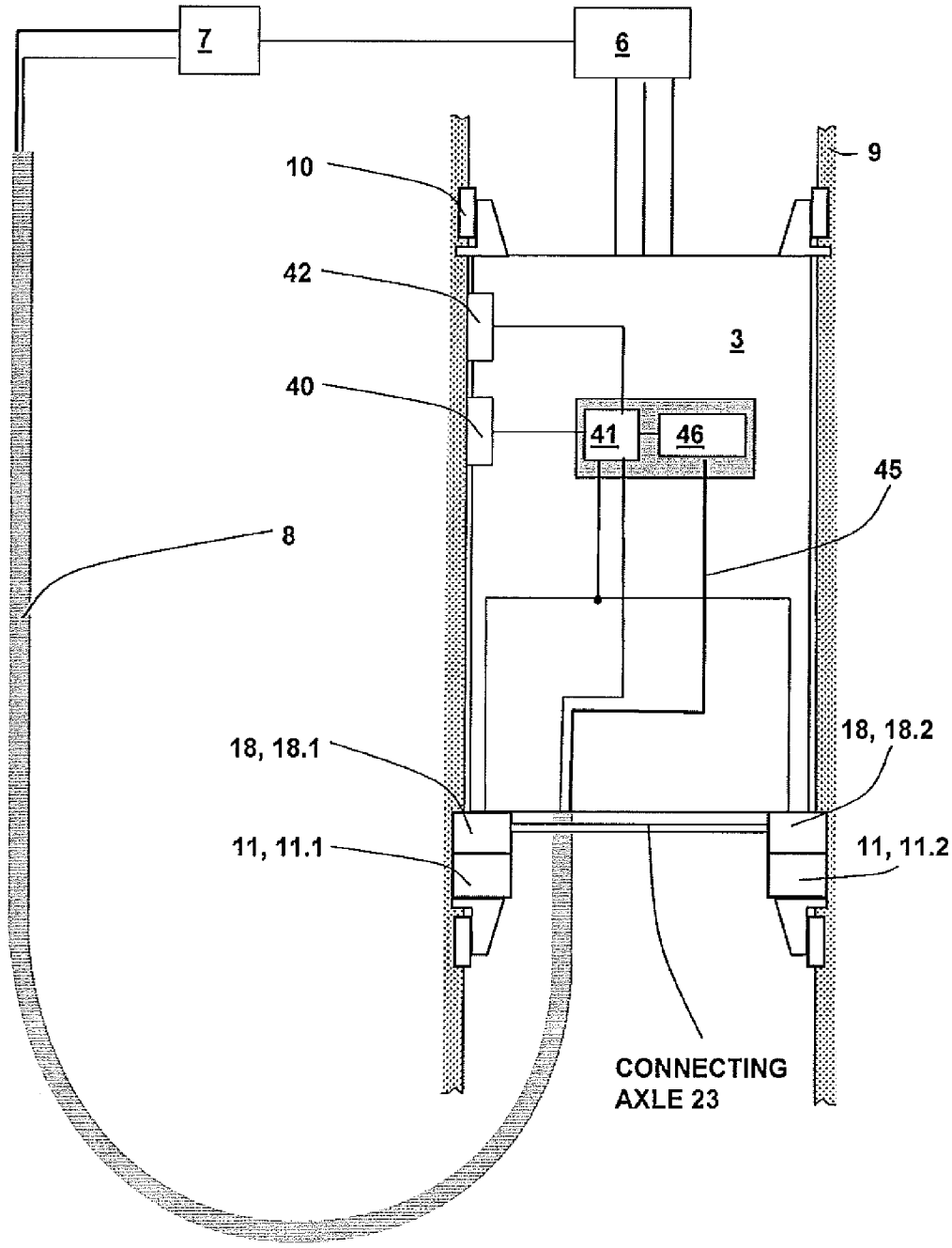
FIG. 3 a diagrammatic illustration of a total system.

FIG. 1 shows an overall view of an elevator system 1. The elevator system 1 is built into an elevator hoistway 2 of a building, and serves to transport persons or goods within the building. The elevator system contains an elevator car 3, which can move upwards and downwards along guiderails 9. The elevator car 3 is guided by guide shoes 10 along the guiderails 9. The elevator car 3 is accessible from the building via doors. A drive 6 serves to drive and hold the elevator car 3. The drive 6 is generally arranged in the upper area of the building, and the elevator car 3 hangs on the drive 6 by means of suspension means 5, for example suspension ropes or suspension belts. The suspension means 5 are passed over the drive 6 and further to a counterweight 4. The counterweight compensates part of the mass of the elevator car 3 so that the drive 6 need essentially only compensate, or drive and hold, an imbalance between the elevator car 3 and the counterweight 4. The counterweight 4 is also guided by guide shoes 10 along the guiderails 9. The guide shoe 10 for the elevator car 3 and the counterweight 4 are generally selected according to the expected guiding forces. So-called sliding guides or roller guides can be used. The drive 6 is arranged, for example, in the upper area of the elevator hoistway 2. It can self-evidently also be arranged at another location in the building, or in the area of the car 3, or of the counterweight 4. As also shown in FIG. 3, the elevator system 1 is controlled by an elevator control 7. For this purpose, this elevator control 7 primarily controls the drive 6, and also contains safety elements which monitor movements of the elevator car in relation to its surroundings—e.g. the state of closure of the doors. The elevator control 7 is connected via a traveling cable 8 to the elevator car 3. Via the traveling cable 8, electrical energy and control signals are transmitted. Instead of a traveling cable, cableless systems, for example with wireless transmission of signals and current tracks with sliding contacts, can be used for the transmission of energy.

The elevator car 3 is equipped with a safety gear 11 which is suitable for securing and/or decelerating the elevator car 3 in the event of an unexpected movement, overspeed, or at a stop. In the example, the safety gear 11 is arranged under the elevator car 3. The safety gear 11 is electrically controlled and, for this purpose, is connected to a device for actuating the safety gear 18. Provided for controlling this device for actuating the safety gear 18 is a safety device 41 and optionally a monitoring device 42. The safety device 41 is connected to sensors. Such a sensor is, for example, a speed sensor 40. The speed sensor 40 can be a tachogenerator or an increment pulse generator which, for example, is integrated into one or more guide rollers or also into return pulleys. Position transducers or acceleration sensors can also be used, from which a momentary travel speed can be determined. From these signals, the safety device 41 determines the safety state of the elevator system, and correspondingly triggers the device for actuating the safety gear 18. Possibly arranged in the area of the safety device 41 is also an energy store 46, for example an accumulator in the form of supercapacitors. This makes it possible in this elevator system to dispense with a mechanical speed governor such as is normally used.

The monitoring device 42 monitors, for example, the elevator car at standstill, when the elevator car is stationary at a floor for the purpose of loading or unloading. The monitoring device monitors the stationary position of the elevator car and, in case of need, triggers a corresponding device for actuating the safety gear.

FIG. 2 shows a plan view of the elevator system of FIG. 1. In the example, the car 3 and the counterweight 4 are each guided with a pair of guiderails 9, and the elevator car contains a pair of safety gears 11, a first safety gear 11.1 acting on one of the guiderails 9, and a second safety gear 11.2 acting on the other of the guiderails 9. Each of the safety gears 11.1, 11.2 has an assigned device for actuating the safety gear 18.1, 18.2.

Figure 4:
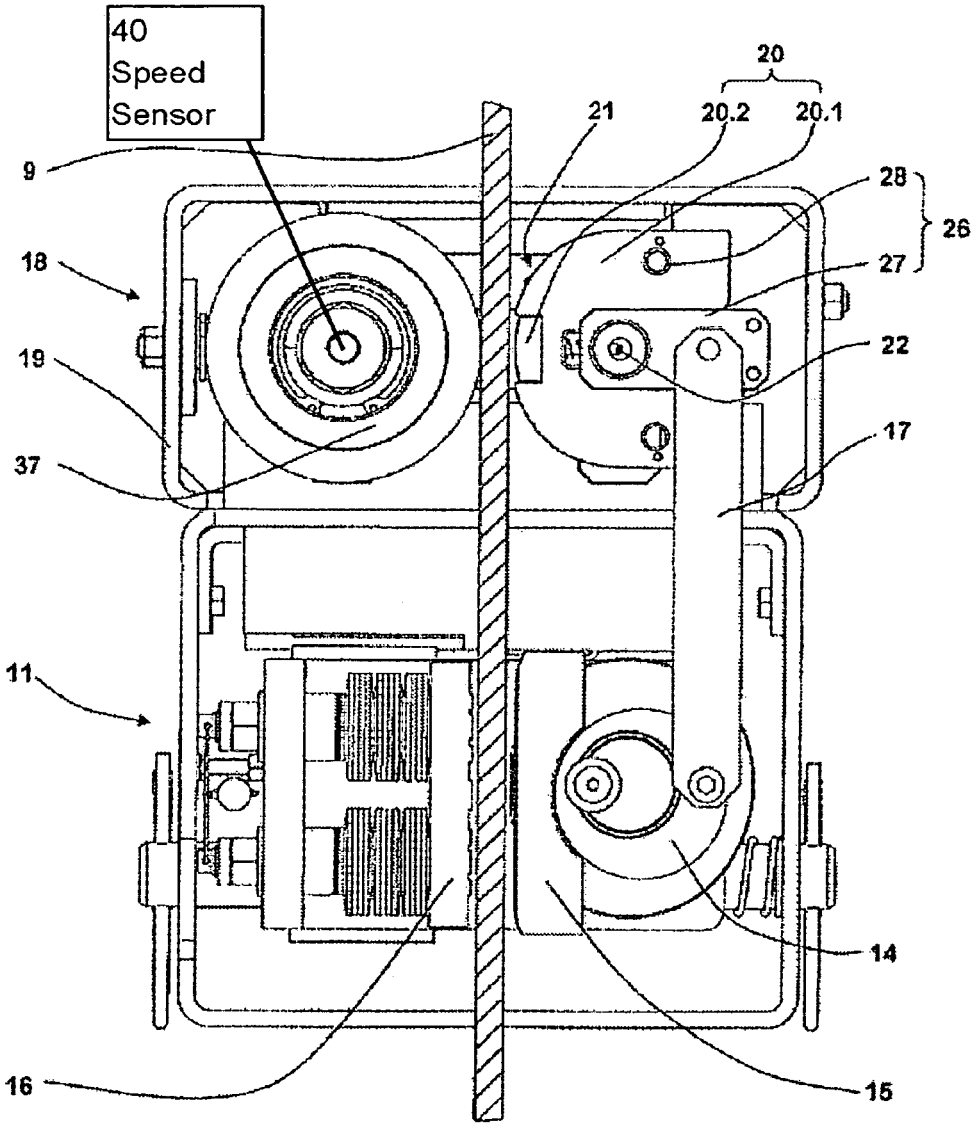
FIG. 4 a device for actuating the safety gear together with a mounted safety gear in a ready position.
Figure 5:
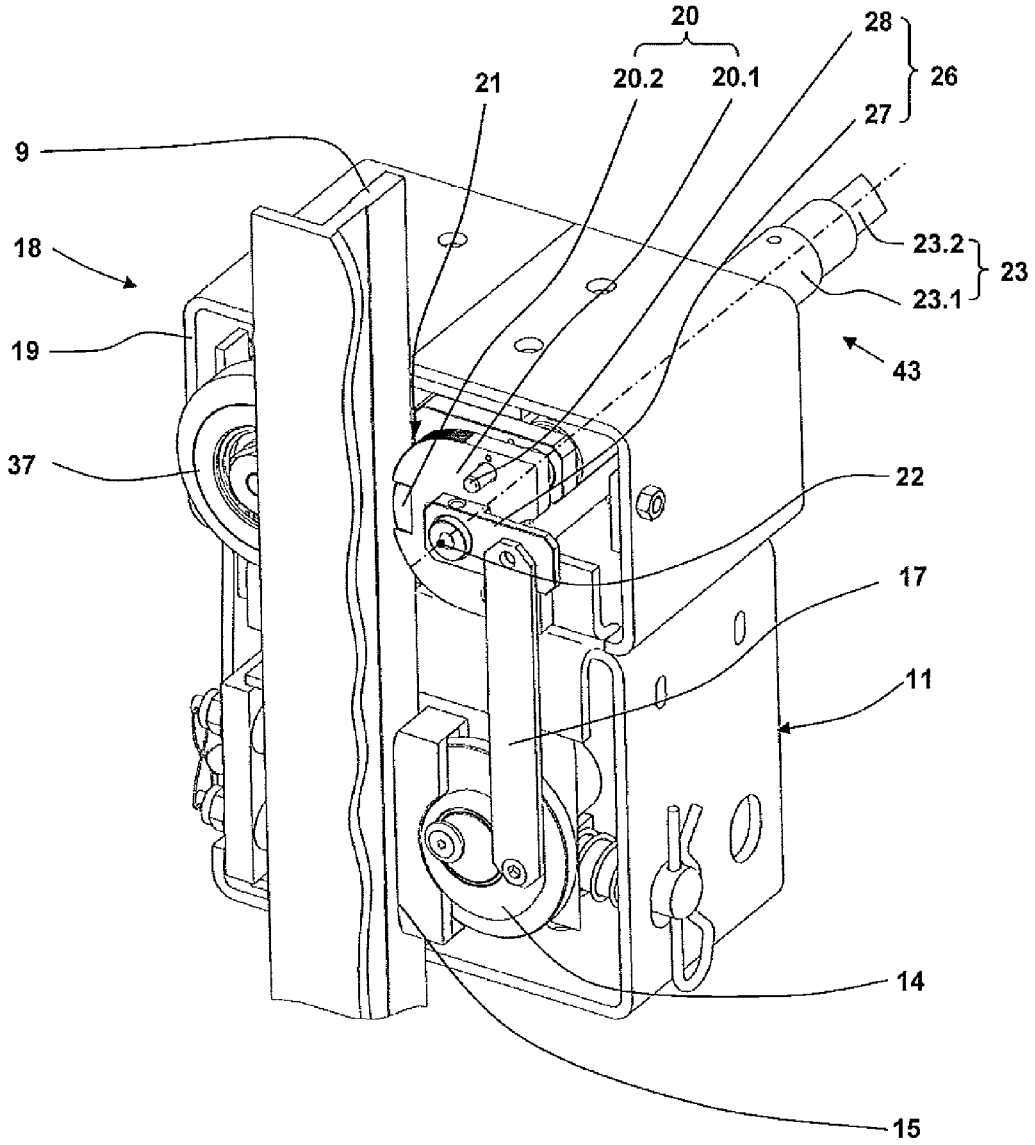
FIG. 5 a perspective view of the device of FIG. 4.

Both of the devices for actuating the safety gear 18, 18.1, 18.2, and the corresponding safety gears 11, 11.1, 11.2 that are to be controlled, are constructed functionally identical. They may differ through being constructed as mirror images. In the following explanations of the device for actuating the safety gear, although reference is made to only one of the devices for actuating the safety gears 18, this always includes the left-hand as well as the right-hand device for actuating the safety gear 18.1, 18.2. In the example according to FIGS. 4 to 8, this device for actuating the safety gear is constructed directly together with the safety gear 11. The safety gear 11 that is used in the example is a known eccentric safety gear. It contains a brake shoe 15 which, in case of need, is presented by an eccentric 14 to the braking surface of the guiderail 9. For this purpose, the eccentric is moved or turned by a connecting bar 17. Via an opposite brake lining 16, a counterforce is then developed. The device for actuating the safety gear 18 is arranged above the safety gear 11 and, via the connecting bar, can actuate the safety gear. The device for actuating the safety gear 18 is integrated into a housing 19. A counterpressure roller 37 that is built into the housing 19 guides the housing 19, and hence the device for actuating the safety gear 18, precisely positioned along the guiderail 9. The counterpressure roller 37 is generally embodied sprung. Alternatively, it can also directly contain the speed sensor 40 (shown in FIG. 4). Located in the device for actuating the safety gear 18 is the coupler body 20. The coupler body 20 is mounted swivelably relative to a rotating axle 22. As can be seen in FIG. 5, the rotating axle 22 can be connected via a connecting axle 23 to the oppositely situated device for actuating the safety gear 18.1, 18.2 (see FIGS. 3, 11), so that the two devices for actuating the safety gear 18.1, 18.2 move mutually synchronously. By means of a latch or spring mechanism, the rotating axle 22, or coupler body 20 respectively, is held in the ready position shown in FIG. 4. In this ready position, between the coupler body 20, or a coupler surface 21 of the coupler body 20 respectively, and the guiderail 9, an air gap is present. This allows the elevator car, on which this device for the purpose of actuating the safety gear 18 is mounted, to be moved without hindrance. Corresponding to the ready position of the device for actuating the safety gear 18, the safety gear 11 is also in its ready position, i.e. brake shoe 15, eccentric 14, and opposite brake lining 16 display an air gap to the guiderail 9.

Also borne on the swivel axle 22 is a control arm 27. The control arm 27 is movable relative to the coupler body 20. By use of a safety gear that is actuatable on both sides, as shown in the example, it is held in a normal position—in the example, horizontal. This retainer can be embodied, for example, by a ball catch, or magnetically, or by means of springs. Arranged on the coupler body 20 are couplers 28. On turning of the coupler body 20, the control arm 27 is held in the normal position until the coupler 28 entrains the control arm 27 (see FIG. 7) and thereby turns the swivel axle 22.

Relative to the swivel axle 22, the coupler surface 21 of the coupler body 20 is embodied in such manner that a distance of the coupler surface 21 to the swivel axle 22, depending on an angle of rotation that results from turning of the coupler body 20, increases.

In the example, the coupler body 20 is embodied in two parts. It contains a fixed coupler part 20.1, which forms the main body of the coupler body 20. The fixed coupler part 20.1 contains the coupler 28, which, when sufficiently turned, entrains the control arm 27. Embedded in the fixed coupler part 20.1 is a movable coupler part 20.2. In the ready position, as shown in FIGS. 4 and 5, the movable coupler part 20.2 is held retracted in the fixed coupler pail 20.1. An associated feeder device 43 is explained with reference to FIGS. 9*a* and 9*b*.

Figure 6:
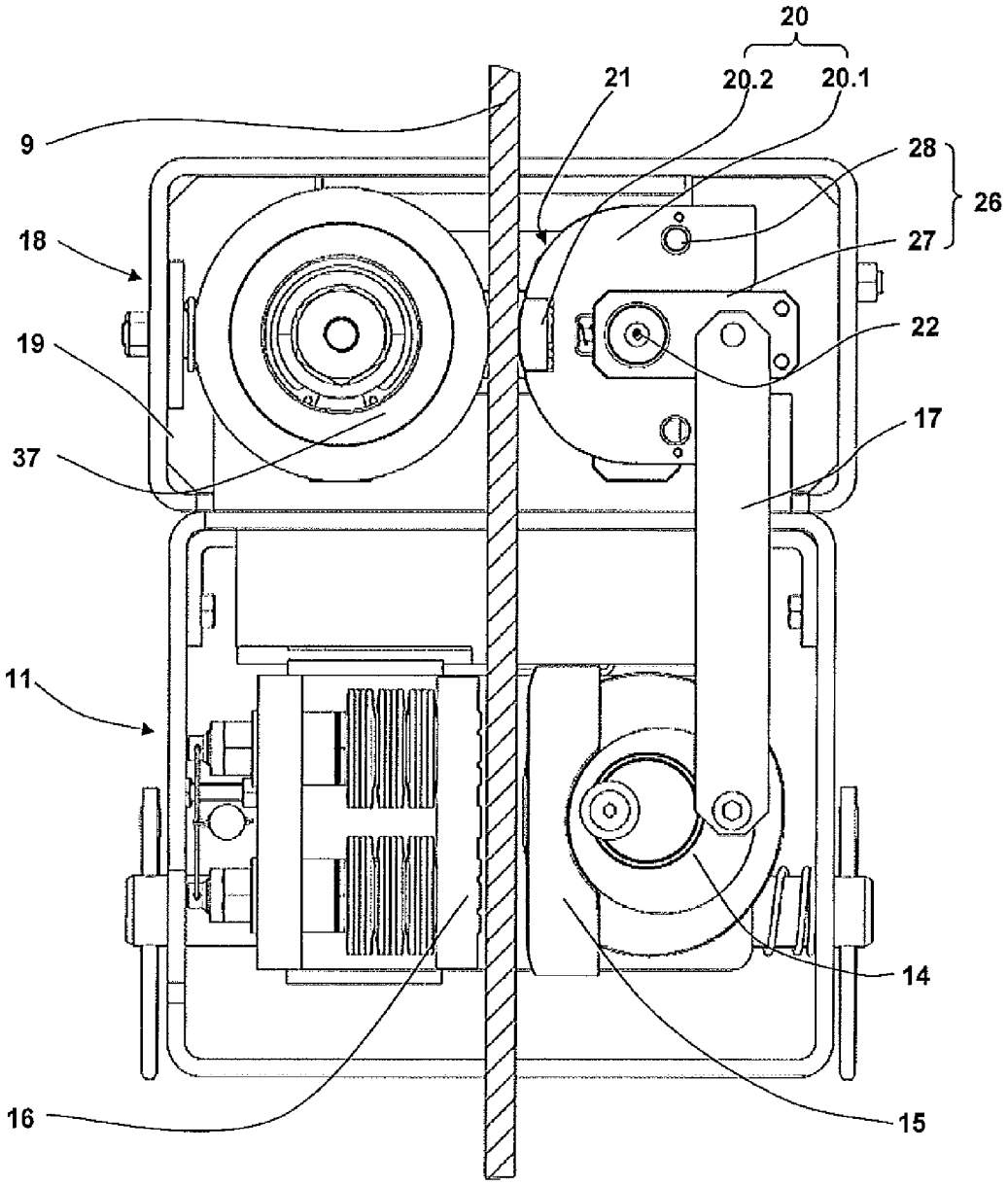
FIG. 6 the device of FIG. 4 in a first actuating position.

If the device for actuating the safety gear 18 is now triggered, for example, by the safety device 41 or the monitoring device 42 (FIG. 1, 3, or 11), the movable coupler part 20.2 is presented to the guiderail 9 as in FIG. 6. As long as the traveling body, or the device for actuating the safety gear 18, remains stationary relative to the guiderail 9, the safety gear 11 remains unactuated. The movable coupler part 20.2 itself could hence be retracted into the ready position again. This is helpful, for example, when using the device for actuating the safety gear for securing the elevator car at a stop, or also during a relatively long power outage. Although an energy store can hold the movable coupler part 20.2 in the ready position for a predefined time, for energy-saving or other reasons, the movable coupler part 20.2 can be presented to the guiderail 9. In the event of the elevator system being switched on again, only the movable coupler part can be moved into the ready position again, and the system is again ready for operation. For the purpose of saving energy also during a relatively short stop at a landing or at a story—when, for example, no travel command is pending—the movable coupler part 20.2 can be presented to the guiderail 9. As soon as a travel command is pending, the movable coupler part can be simply moved back into the ready position.

Figure 7:
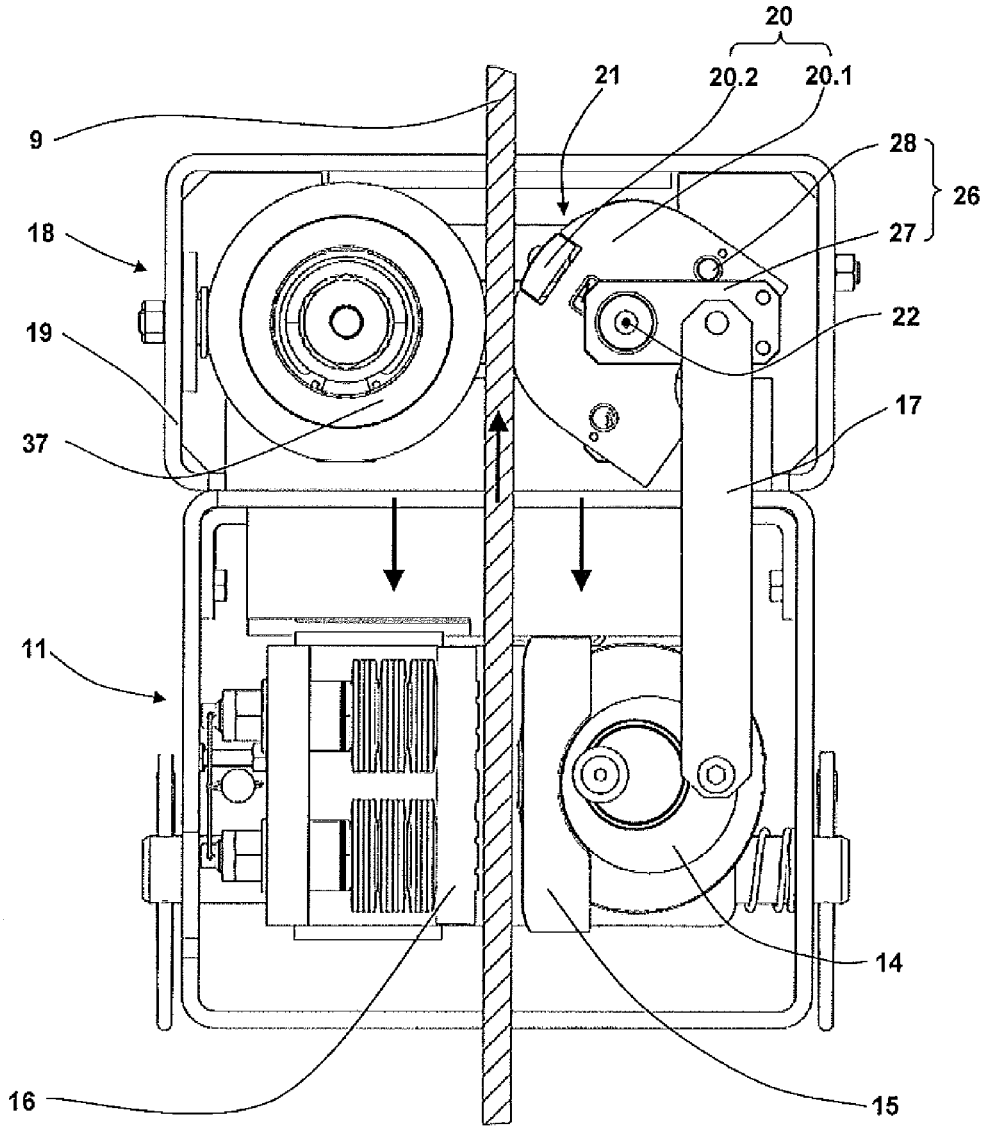
FIG. 7 the device of FIG. 4 in a second actuating position.

However, as soon as the traveling body or the device for actuating the safety gear 18, as shown in FIG. 7, moves further relative to the guiderail 9, the coupler body 20 is turned on the swivel axle 22 by the coupler surface 21 that is determined by the movable coupler part 20.2 and the fixed coupler part 20.1. However, as long as the coupler 28 of the free-running device 26 has not reached the control arm 27, the control arm 27 remains in its rest position. The safety gear 11 itself remains unactuated. Since only the coupler body 20 need be moved over this movement distance, a press-on force can be kept relatively small. Via a curve of the coupler surface 21, this press-on force can be slowly increased so that, after execution of the free-run of the free-running device 26, a sufficient pressing, and hence coupling, force is available for actuation of the safety gear 11.

Figure 8:
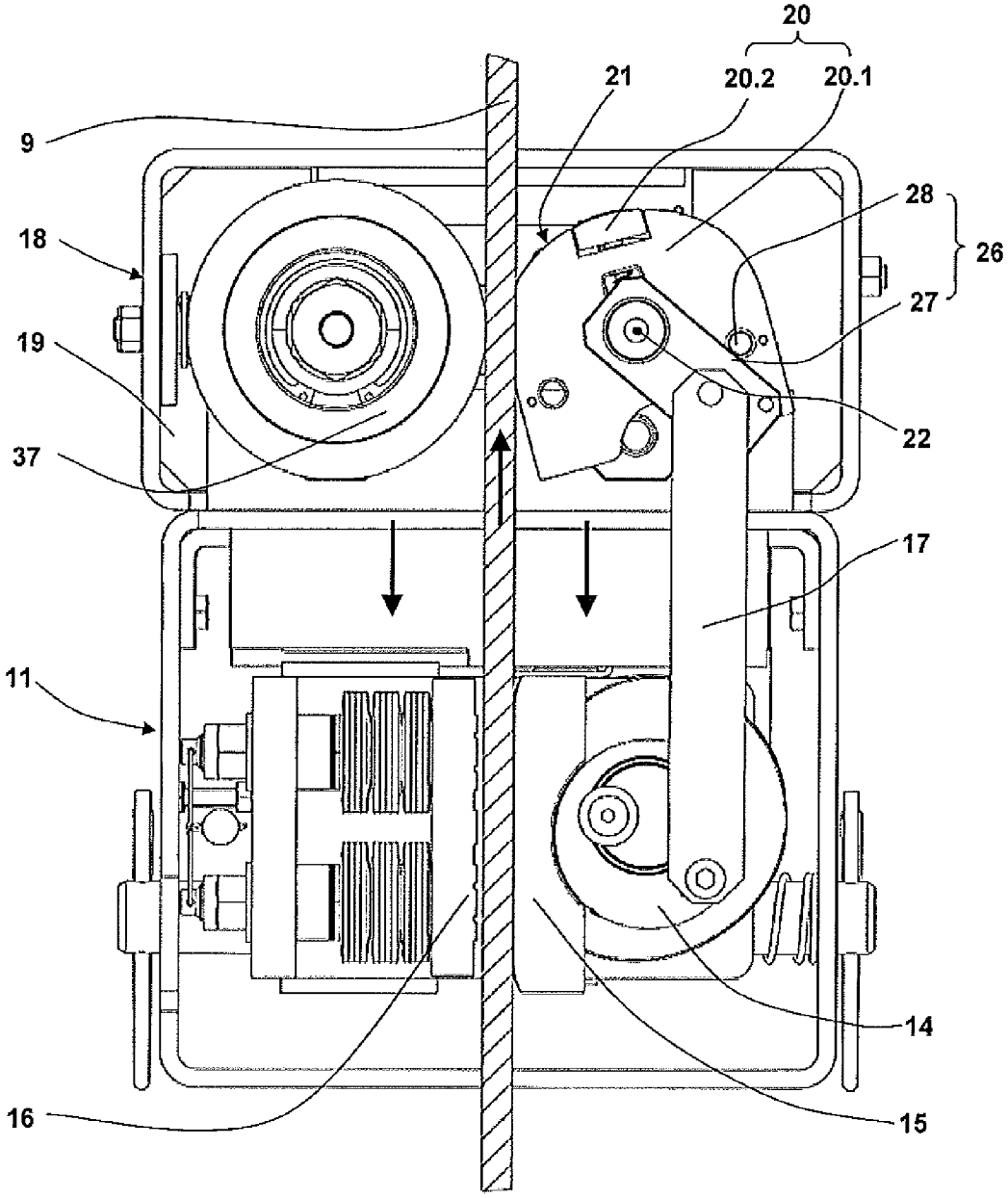
FIG. 8 the device of FIG. 4 in a braking position.

However, if the traveling body or the device for actuating the safety gear 18, as shown in FIG. 8, now continues to move relative to the guiderail 9, the coupler body 20 is turned further on the swivel axle 22 by the coupler surface 21 that is determined by the movable coupler part 20.2 and the fixed coupler part 20.1. The coupler 28 of the free-running device 26 now takes the control arm 27 with it and thereby actuates via the connecting bar 17 the safety gear 11, or turns the eccentric 14 into frictional contact with the guiderail 9, and thereby effects generation of a braking force via the brake shoe 15 and the opposite brake lining 16. The traveling body of the elevator system or elevator car can thereby be safely brought to a standstill.

By means of the connecting bar 17 and a possible arrangement of levers or joints, also safety gears with engagement wedges or engagement rollers can be used or actuated. In the case of such safety gears, instead of the eccentric, a wedge or roller can be correspondingly raised.

Figure 9A:
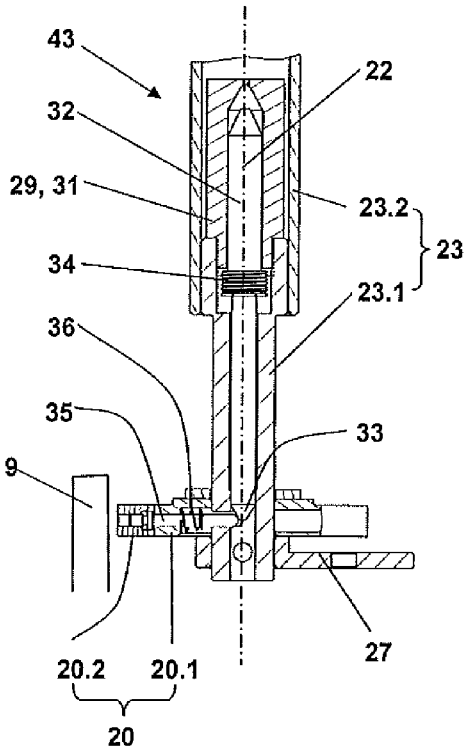
FIG. 9*a* an electromechanical feeder device in a ready position.
Figure 9B:
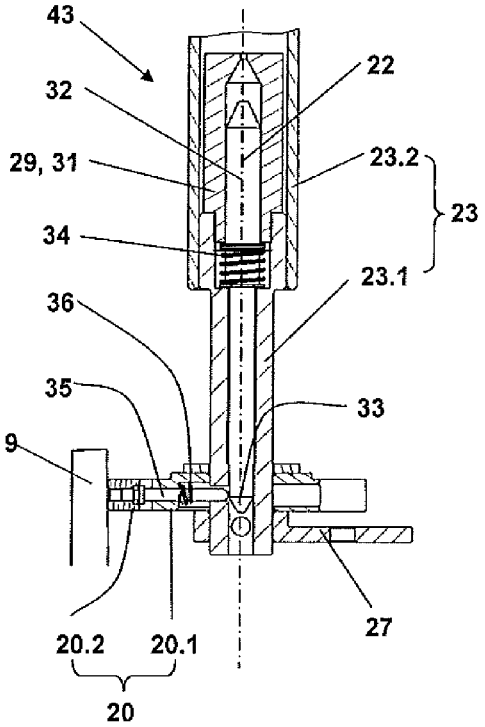
FIG. 9*b* the electromechanical feeder device of FIG. 9*a* in a first actuating position.

As mentioned, in the example of FIG. 5, the feeder device 43 is embodied as a component of the connecting axle 23. In FIGS. 9*a* and 9*b*, the function of this feeder device 43 is specifically explained. The figures show a horizontal cross section through the connecting axle 23, which, in the end-area, possibly in both end-areas, contains such a feeder device 43. In FIG. 9*a*, between the braking surface of the guiderail 9 and the coupler body 20, is an air gap. This corresponds to the ready position of the device for actuating the safety gear as explained and shown in FIG. 4. The fixed coupler part 20.1 is arranged on the connecting element 23.1 of the connecting axle 23. In this fixed coupler part 20.1, the movable coupler part 20.2 is held via a guide pin 35. A guide spring 36, possibly as shown a compression spring, presses via the guide pin 35 the movable coupler part 20.2 of the guiderail away, or pulls it into the fixed coupler part 20.1. Arranged in the center of the connecting element 23.1 of the connecting axle 23 is an electromagnet 29, which can attract an armature pin 32. In the currentless state of the electromagnet 29, the armature pin 32 is pressed by an armature spring 34 into an operating position and, in the under-current state of the electromagnet 29, is held against the armature spring 34 in the ready position. If, as shown in FIG. 9*b*, the armature pin 32 is pressed by the armature spring 34 into the operating position, by means of its conical embodiment, a point 33 presses against the guide pin 35, and hence the movable coupler part 20.2 against the guiderail 9. Hence the armature spring 34 acts as pressing-on spring 34, which presses the movable coupler part 20.2 against the guiderail 9. The pressing-on force against the guiderail 9 is thereby generated, and the coupler body 20 can be turned or actuated as previously described.

By switching the electromagnet 29 on and off, the movable coupler part 20.2 of the coupler body 20 can be switched, or moved, between the ready position and the operating position. In the example, the under-current state of the electromagnet 29 corresponds to the ready position. Since, in the first step of actuating the safety gear 11, only the coupler body 20 is moved, an associated press-on force can be selected small. This means that a correspondingly smaller electromagnet can be chosen, whereby also an energy consumption can be held small.

Self-evidently, in principle, this operating principle can also be used in reverse, through an energized electromagnet pressing against the movable coupler part 20.2 and the armature spring holding the coupler part in the ready state. Although this requires less energy, it requires a supply of electrical energy at all times.

When the coupler body 20 is swiveled on the connecting axle 23 or on the connecting element 23.1 of the connecting axle 23 respectively according to the free run of the free-running device 26 (see FIGS. 4 to 8), the control arm 27 is turned along with the connecting axle 23, whereby an inevitably synchronous actuation of the devices for actuating the safety gear 18, or the associated safety gears 11, takes place.

Figure 10:
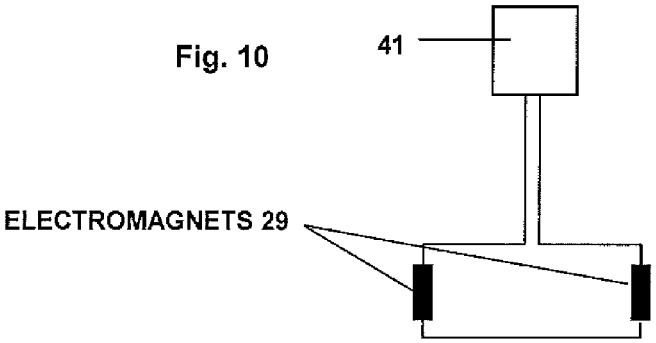
FIG. 10 a switching arrangement for switching the device for actuating the safety gear.

Since, possibly, a feeder device 43 is built into both end-areas of the connecting axle 23, also in the case of a failure of one of the feeder devices 43, both safety gears can still be actuated synchronously. As shown diagrammatically in FIG. 10, advantageously the two electromagnets 29 of the two feeder devices 43 are connected in series to the safety device 41. By this means, for example, in the event of a defect in a wire winding of the electromagnet, the second electromagnet that is connected in series is also immediately interrupted.

The feeder device, or an operating position of the device for actuating the safety gear respectively, can be monitored by means of electric switches or sensors. These switches or sensors are not shown in the figures, they are arranged by the expert according to need.

Figure 11:
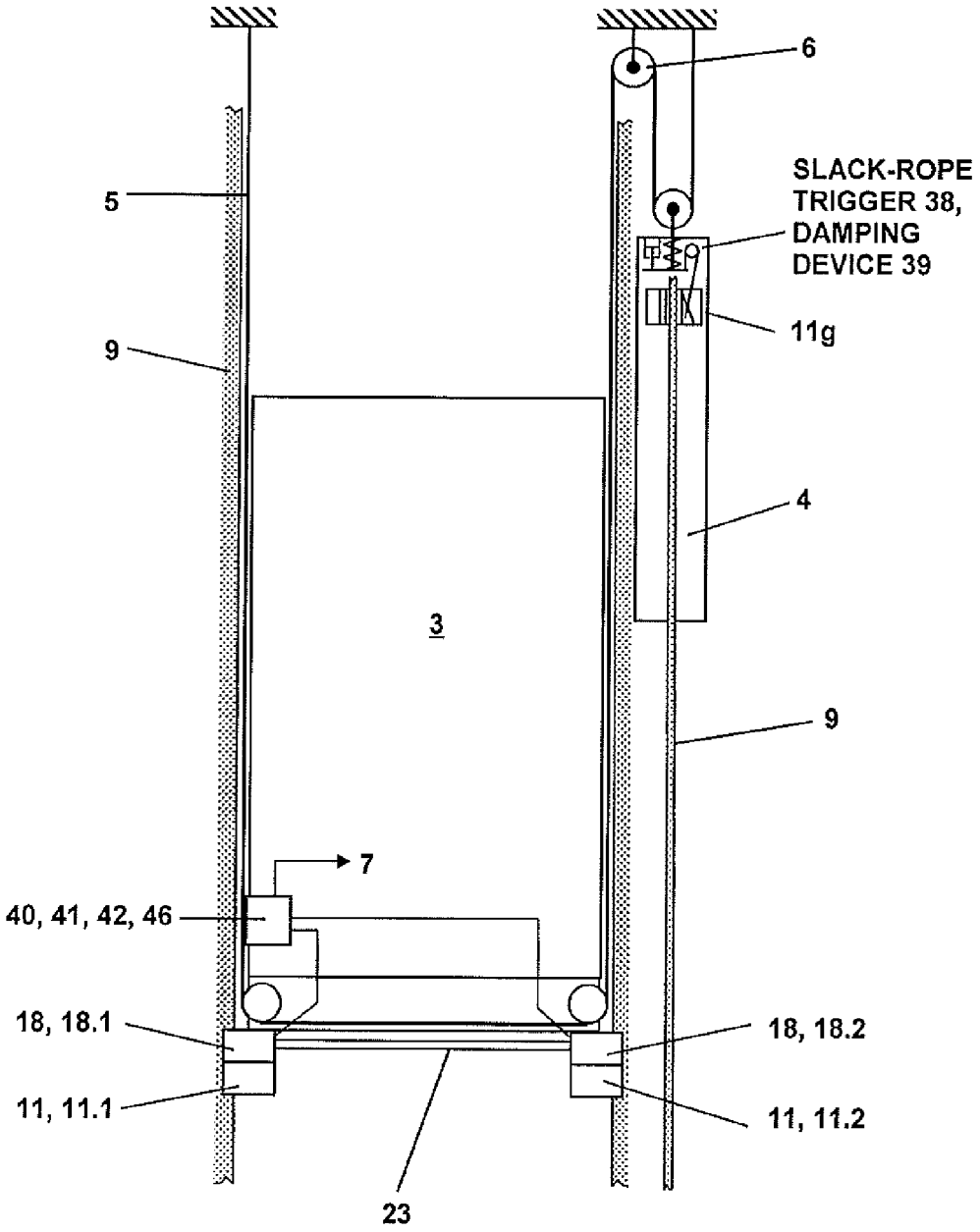
FIG. 11 a diagrammatic view of an elevator system with a safety gear on the counterweight.

Shown in FIG. 11 is an embodiment of the safety concept of an elevator system 1 which is complementary or alternative to FIGS. 1 to 3. Herein, the elevator car 3 with safety gears 11 and associated devices for actuating the safety gear 18, with corresponding control devices such as safety device 41 and/or monitoring device 42, is equipped with speed sensors 40 and possible energy stores 46, as previously described. In this example, the counterweight 4 is equipped with an essentially known safety gear 11*g*, which is actuated by a slack-rope trigger 38. This means that, when a suspension force falls below a preset value for a predefined period of time, the safety gear 11*g* is actuated. If, for example, the suspension means 5 in the elevator system breaks, the safety gear 11 of the elevator car 3 would be actuated via the corresponding control devices, and the elevator car 3 would be safely braked. Because of the now suddenly absent suspension force in the suspension means, the slack-rope trigger 38 would now actuate the safety gear 11*g* of the counterweight, and secure the counterweight 4 against falling. By means of a triggering delayer or damping device 39 in the slack-rope trigger 38, it is ensured that a momentary oscillation effect in the slack-rope trigger 38 does not trigger the safety gear 11*g*.

The counterweight 4 can also be provided with a device for actuating the safety gear 18 as explained in the foregoing descriptions, wherein triggering of the latter can take place through a separate control device, or through control and energy connections via traveling cables, compensating ropes, or suchlike.

The arrangements shown can be adapted to various elevator systems. For example, the brakes can be mounted above or below the car 3. Also a plurality of brake pairs can be used on a car 3. The brake device can also be used in an elevator system with a plurality of cars, each of the cars then having at least one such brake device. In case of need, the brake device can also be mounted on the counterweight 4, or it can be mounted on a self-propelled car.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator system, comprising:

a traveling body, the traveling body being configured to travel along a guiderail in an elevator hoistway;

a safety gear, the safety gear being arranged on the traveling body and configured to brake and hold the traveling body on the guiderail or on a braking rail; and a safety gear actuating device, the safety gear actuating device being arranged on the traveling body and connected to the safety gear, the safety gear actuating device comprising at least one coupler body configured to be pressed against the guiderail or the braking rail, the safety gear being activatable by a relative movement between the pressed coupler body and the safety gear, the coupler body comprising a coupler surface arranged swivelably about a swivel axle in the safety gear actuating device, the coupler surface being configured such that a force of the coupler body on the guiderail or the braking rail increases over a swivel range of the coupler body.

2. The elevator system of claim 1, the at least one coupler body being configured to be pressed against the guiderail of the elevator hoistway.

3. The elevator system of claim 1, the at least one coupler body being configured to be pressed against a braking rail of the elevator hoistway.

4. The elevator system of claim 1, the coupler surface comprising a curved surface.

5. The elevator system of claim 1, the guiderail being a first guiderail, the traveling body being further configured to travel along a second guiderail in the elevator hoistway, the safety gear being a first safety gear and being configured to interact with the first guiderail, the safety gear actuating device being a first safety gear actuating device and being configured to actuate the first safety gear, the elevator system further comprising:

a second safety gear;

a second safety gear actuating device, the second safety gear being configured to interact with the second guiderail and being actuatable by the second safety gear actuating device, the swivel axle of the first safety gear actuating device being coupled to the swivel axle of the second safety gear actuating device to allow the first and second safety gears to be actuated essentially synchronously.

6. The elevator system of claim 5, each of the first and second safety gear actuating devices being configured to activate both of the first and second safety gears.

7. The elevator system of claim 1, the coupler surface being connected to the safety gear by a free-running device, the force of the coupler body against the guiderail or the braking rail being set to increase over a first range of relative movement between the coupler body and the safety gear, and the safety device being configured to actuate over a second range of relative movement between the coupler body and the safety gear.

8. The elevator system of claim 1, the safety gear actuating device further comprising:

a spring, the spring being configured to press the at least one coupler body against the guiderail or the braking rail; and an electromagnet, the electromagnet being configured to hold the at least one coupler body in a ready position.

9. The elevator system of claim 1, the at least one coupler body comprising a movable coupler part and a fixed coupler part.

10. The elevator system of claim 1, the safety gear actuating device being configured to actuate the safety gear in exactly one of two directions of travel of the traveling body.

11. The elevator system of claim 10, the safety gear comprising an eccentric safety gear.

12. The elevator system of claim 1, the safety gear actuating device being configured to actuate the safety gear in two directions of travel of the traveling body.

13. The elevator system of claim 1, the safety gear actuating device further comprising a counterpressure roller, the counterpressure roller being arranged on a surface of the guiderail or the braking rail.

14. The elevator system of claim 13, the counterpressure roller comprising a speed measuring device.

15. The elevator system of claim 14, the speed measuring device being coupled to a speed monitoring device.

16. The elevator system of claim 1, the traveling body comprising an elevator car, the safety gear actuating device being connected to an electronic safety device, the electronic safety device being configured to trigger the safety gear actuating device upon detecting that a travel speed of the elevator car has deviated from a reference speed.

17. The elevator system of claim 1, the traveling body comprising an elevator car, the safety gear actuating device being connected to a monitoring device, the monitoring device being configured to trigger the safety gear actuating device upon detecting that the elevator car is drifting away from a standstill position.

18. The elevator system of claim 1, the traveling body comprising a counterweight.

19. An elevator operation method, comprising:

pressing, against a guiderail or a braking rail, a coupler surface of a coupler body in a safety gear actuating device, the coupler surface arranged swivelably about a swivel axle in the safety gear actuating device, the coupler surface being configured such that a force of the coupler body on the guiderail or the braking rail increases over a swivel range of the coupler body;

activating a safety gear as a result of a relative movement between the coupler body and the safety gear, the safety gear being coupled to the safety gear actuating device.

20. An elevator system, comprising:

a traveling body, the traveling body being configured to travel along a guiderail in an elevator hoistway;

a safety gear, the safety gear being arranged on the traveling body and configured to brake and hold the traveling body on the guiderail or on a braking rail; and a safety gear actuating device, the safety gear actuating device being arranged on the traveling body and connected to the safety gear, the safety gear actuating device comprising at least one coupler body configured to be pressed against the guiderail or the braking rail, the safety gear being activatable by a relative movement between the pressed coupler body and the safety gear, the coupler body comprising a coupler surface arranged swivelably about a swivel axle in the safety gear actuating device, the safety gear actuating device being arranged adjacent to and above or below the safety gear the coupler surface being configured such that a force of the coupler body on the guiderail or the braking rail increases over a swivel range of the couple body.

21. The elevator system of claim 20, the guiderail being a first guiderail, the traveling body being further configured to travel along a second guiderail in the elevator hoistway, the safety gear being a first safety gear and being configured to interact with the first guiderail, the safety gear actuating device being a first safety gear actuating device and being configured to actuate the first safety gear, the elevator system further comprising:

a second safety gear;

a second safety gear actuating device, the second safety gear being configured to interact with the second guiderail and being actuatable by the second safety gear actuating device, the swivel axle of the first safety gear actuating device being coupled to the swivel axle of the second safety gear actuating device to allow the first and second safety gears to be actuated essentially synchronously.

22. The elevator system of claim 21, each of the first and second safety gear actuating devices being configured to activate both of the first and second safety gears.

23. The elevator system of claim 20, the coupler surface being connected to the safety gear by a free-running device, the force of the coupler body against the guiderail or the braking rail being set to increase over a first range of relative movement between the coupler body and the safety gear, and the safety device being configured to actuate over a second range of relative movement between the coupler body and the safety gear.

24. The elevator system of claim 20, the safety gear actuating device further comprising:

a spring, the spring being configured to press the at least one coupler body against the guiderail or the braking rail; and an electromagnet, the electromagnet being configured to hold the at least one coupler body in a ready position.

* * * * *